United States Patent [19]

Cartwright

[11] Patent Number: 4,810,353

[45] Date of Patent: Mar. 7, 1989

[54] POP-UP TABLE FURNITURE WITH STORAGE FACILITY

[76] Inventor: John V. Cartwright, 4353 Mariota Ave., Toluca Lake, Calif. 91602

[21] Appl. No.: 93,210

[22] Filed: Sep. 4, 1987

[51] Int. Cl.[4] ..... A47B 9/18

[52] U.S. Cl. ..... 108/33; 108/144; 312/312

[58] Field of Search ..... 108/33, 42, 50, 150, 108/144, 136, 146, 147; 312/312, 71; 52/169.1, 169.5, 169.6; 404/6, 9; 49/35, 49, 131

[56] References Cited

U.S. PATENT DOCUMENTS

| | | | |
|---|---|---|---|
| 23,184 | 3/1859 | Mc Avoy | 312/312 X |
| 328,475 | 10/1885 | Ford | 312/312 X |
| 2,025,395 | 12/1935 | Lehn | 108/144 |
| 2,266,268 | 12/1941 | Robinson | 312/312 X |
| 2,410,338 | 10/1946 | Graine | 52/169.5 X |
| 2,649,345 | 8/1953 | Hubbard | 108/144 |
| 4,666,331 | 5/1987 | Riley | 49/49 X |

FOREIGN PATENT DOCUMENTS

| | | | |
|---|---|---|---|
| 509964 | 3/1952 | Belgium | 312/312 |
| 801169 | 11/1950 | Fed. Rep. of Germany | 108/150 |
| 2935970 | 3/1980 | Fed. Rep. of Germany | 108/37 |

*Primary Examiner*—Peter A. Aschenbrenner
*Attorney, Agent, or Firm*—Frank L. Zugelter

[57] ABSTRACT

A Pop-up Table Assembly comprising support sections supporting a table telescopically mounted on a stabilizing shaft secured within a drum mounted in the ground or other sub-structure. The table assembly is releasably positioned in either its elevated mode or down mode (within the drum). U-shaped channel members provide a way to guide the reciprocation of the assembly, and are longitudinally secured to the interior wall of the drum. Means for positively locking the assembly in its down mode is provided. Alternative embodiments of counter-balancing mechanisms are disclosed, whereby raising and lowering of the assembly is facilitated. Drainage passage provide for run-off of water that may accumulate upon the stored assembly or while it is in use. A storage chamber is generated between the table assembly elements and the drum, for introduction of furniture or the like to be stored when the assembly is not in elevated mode or used. Means for initially raising the table assembly from the ground plane is included in order to easily grasp the table to raise the assembly to its elevated mode.

22 Claims, 4 Drawing Sheets

FIG. 1.
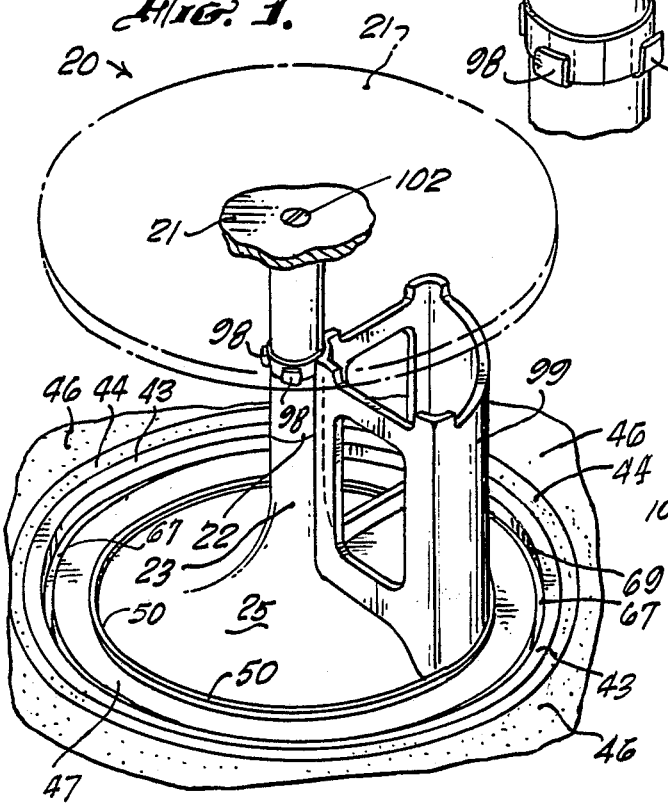
FIG. 11.
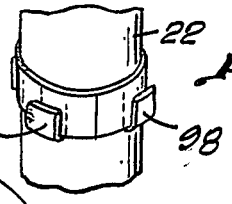
FIG. 12.
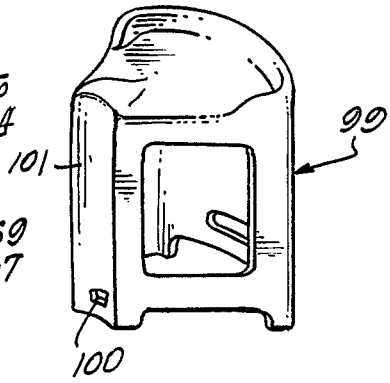
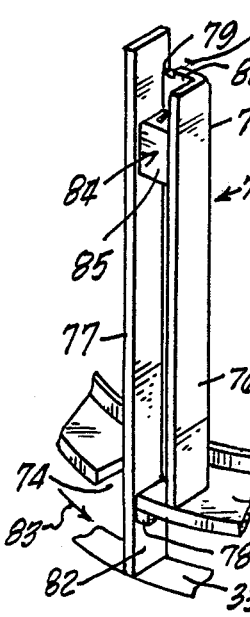
FIG. 8.
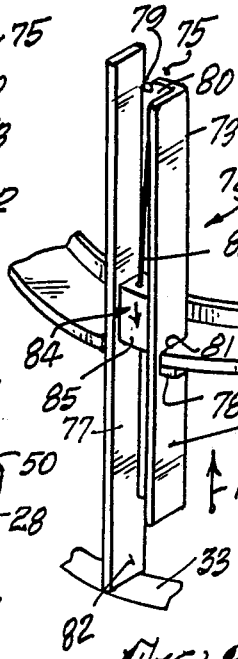
FIG. 9.
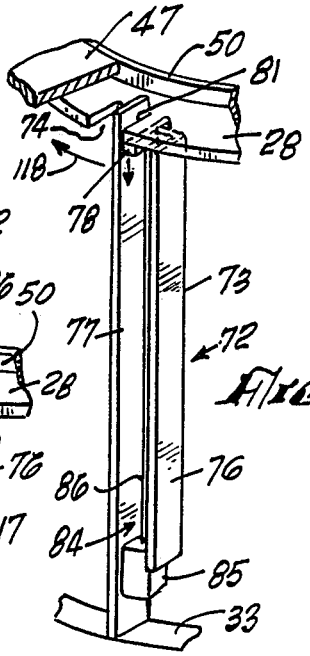
FIG. 10.

POP-UP TABLE FURNITURE WITH STORAGE FACILITY

TECHNICAL FIELD

This invention relates to furniture, and in particular to a furniture table and its chairs, adaptable for patio and other use, the table assembly popping up from out of its storage chamber below foot level, with storage space for chairs and the like included within such storage chamber.

BACKGROUND ART

The following prior art teachings disclose furniture of the same general type: U.S. Pat. Nos: 249,558; 328,883; 619,153; 619,154; 828,136; 841,135; 928,726; 958,000; 2,025,395; 2,484,678; and 4,005,902.

DISCLOSURE OF THE INVENTION

The invention is directed to a table which 'popsup' out of its storage chamber, comprising a table mounted on one or more vertically-oriented support sections which are pinned or otherwise retained to a rigid metal tube inserted through or within the support section or sections. The tube telescopically mounts on a stabilizing shaft secured to the bottom or base of a drum within which the table's assembly, seating furniture and other accessories are stored when tube and table are telescoped onto the shaft in the drum. Rails mounted in the drum guide an annular segment or segments on a lower extension member or members of the table's assembly, between its stored or down mode of position and its elevated or use mode of position. It is releasably positioned in both modes, and further including a locking feature located at floor level for the assembly in its down mode. Seating furniture and floor panels are stored in a cavity or chamber of the table assembly's construction when in its down mode. Drainage passages are provided. Means are provided to initially raise or 'pop-up' the table from its floor level after unlocking of the assembly in its down mode or upon releasing the assembly from its down mode position.

An object of this invention is to provide patio, poolside, or dining area table and furniture, designed to retract into a below-ground or below-foot level storage chamber.

Other objects of the invention are to eliminate from view furniture and to provide further utility of the area in which such furniture would have been disposed.

A further object of the invention is to provide additional ground and area space for utilization of other purposes then merely for dining, or for otherwise sitting at a table, such space being most critical in some industries, examples being the hotel, motel and restuarant industries.

A still further object of the invention is to enhance the immediate areas of patios, pools, recreational areas, by the invisibility of the furniture.

Another object of the invention is to provide multiple uses of the same area of foot walking in which the furniture is located.

A further object of the invention is to eliminate the need for storage sheds or unsightly storage containers or facilities which conventional patio and dining and table furniture require.

These and other objects and advantages will become more apparent upon a full and complete reading of the following disclosure comprising a written description, appended claims thereto, and a drawing comprising three (3) sheets on which fifteen (15) FIGURES are illustrated.

BRIEF DESCRIPTION OF THE DRAWING

FIG. 1 is a perspective view of the invention in its elevated mode or position above ground or foot level area.

FIGS. 8, 9 and 10 are perspective fragmentary views of guide means and different positions of a counter-weight balancing mechanism utilized in the invention for movement between elevated and down modes.

FIG. 11 is a fragmentary perspective view showing means by which chairs, stools, or the like, are mounted to the table assembly.

FIG. 12 is a perspective view of a seat or stool mountable to the table assembly of FIGS. 11 and 1.

BEST MODE FOR CARRYING OUT THE INVENTION

Figure 3:
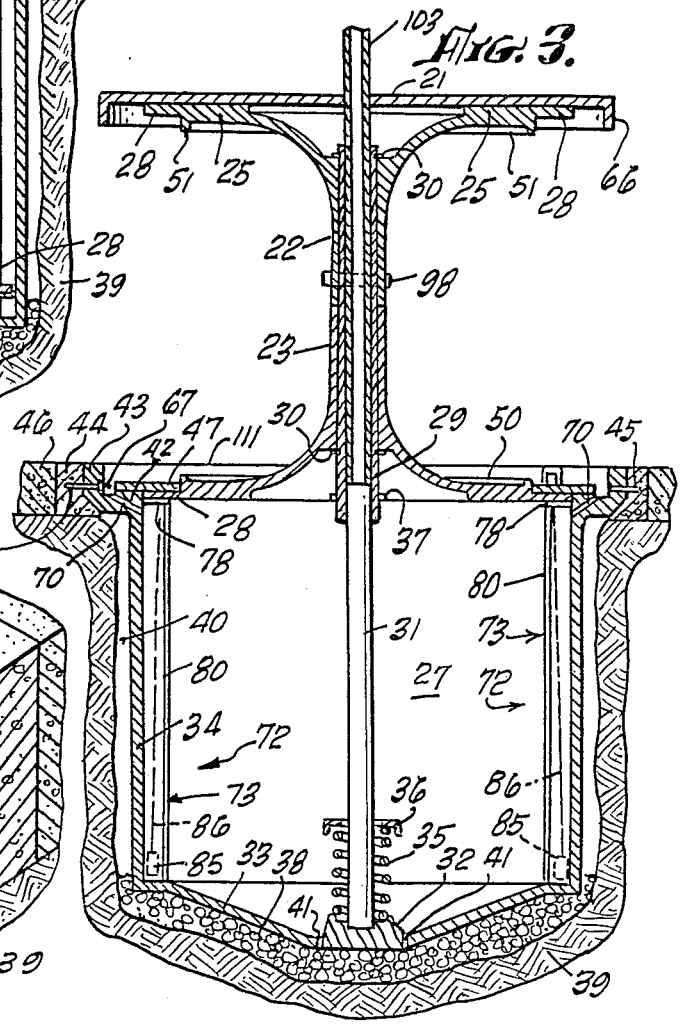
FIG. 3 is an elevational cross-sectional view of the invention in its elevated mode or position.

Referring now to the drawing wherein reference characters therein correspond to like numerals hereinafter, reference character 20 identifies the table assembly embodying the invention. Table assembly 20 comprises a table 21, FIGS. 1–4, securely mounted on and at the top of table support means its construction including a pair of abutting hollow tubular support sections 22, 23. Each support section 22, 23 includes one or more members 25 extending radially outwardly from its vertically-oriented disposition, while each section 22, 23 abuts the like hollow portion of the other support section. With the abutting of both hollow sections 22, 23, a storage space or chamber 27, FIG. 3, is generated between the opposing facing extension members 25. A marginal portion or annular segment 28 is mounted on each of the extension members or means 25, cooperating with another element in both the down and elevated modes for assembly 20, more fully described hereinafter. The hollow abutting sections 22, 23 are mounted to and retained on a rigid tube 29 by means of retaining rings 30, FIGS. 3, 4, which are bonded to tube 29 after hollow sections 22, 23 have been mounted to tube 29. Sections 22, 23 are suitably secured, as by such bonding, or by pinning to tube 29. Tube 29 in turn telescopes upon a pillar or shaft 31 which stabilizes the table assembly. Shaft 31 is seated preferably in a hub 32 formed in the bottom and/or base 33 of a generally cylindrical hollow storage drum 34 and extends upwardly towards the open end of the drum. A coiled spring 35 is mounted about shaft 31, and immediately upon hub 32, while a circular downwardly-flanged plate or spring cap 36 mounts on the top of spring 35 and about shaft 31 which of course holds the spring and plate in position. An annular flange 37 is suitably secured about tube 29 near its lower end, FIG. 3, and is adapted to engage plate 36 as table assembly 20 is displaced towards and into its down or closed mode of position. Spring cap or plate 36 provides a seat for annular flange 37 and ensures that the spring compresses evenly. The action of spring 35 when compressed and with the table assembly in its released position in its down mode provides upward motion to the reciprocable elements operatively connected to the supporting means 22, 23 for the extension members 25 and the assembly in general so that table 21 'pops-up' and can be grasped from above floor level to further raise the assembly to its elevated or open mode. Gravel 38 is provided on ground soil 39, to form a substructure for drum 34 at the bottom of a cavity 40, and to receive water, its condensation, or other liquids introduced into drum 34. Passages 41, FIGS. 3, 4, are provided in base 33 of drum 34, FIG. 4, for drainage of such liquids.

Figure 2:
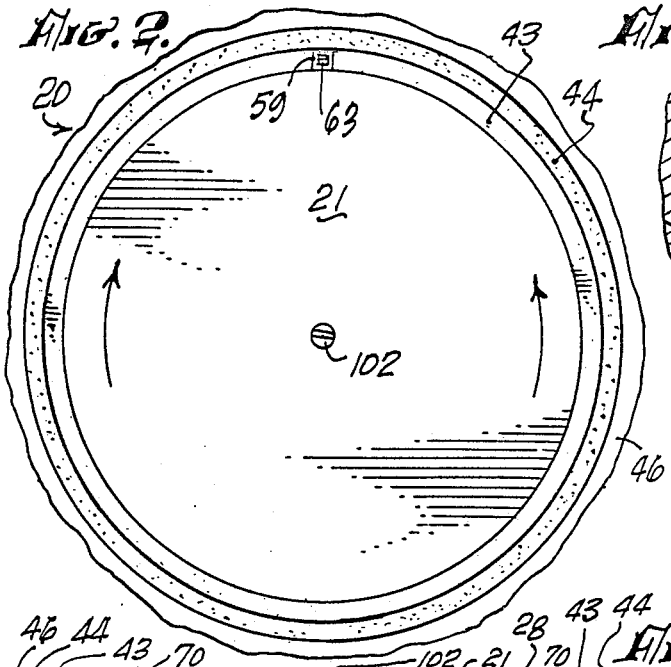
FIG. 2 is a plan view of the subject matter shown in FIG. 1.
Figure 5:
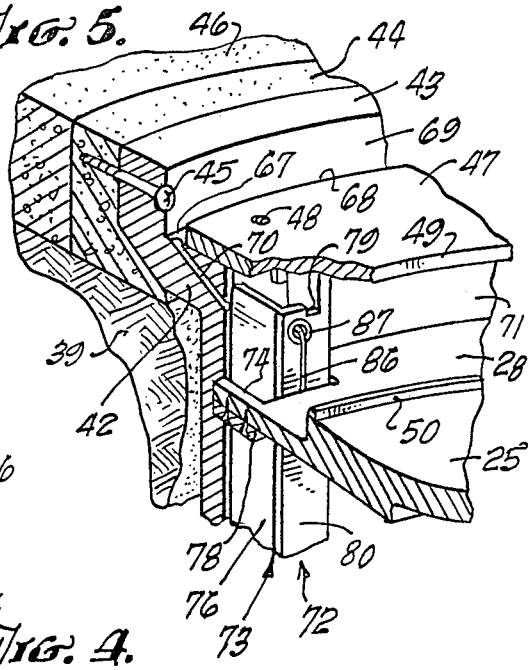
FIG. 5 is an enlarged perspective fragmentary view of the table assembly, in reciprocal motion, as it is moving towards or away from its elevated mode.
Figure 6:
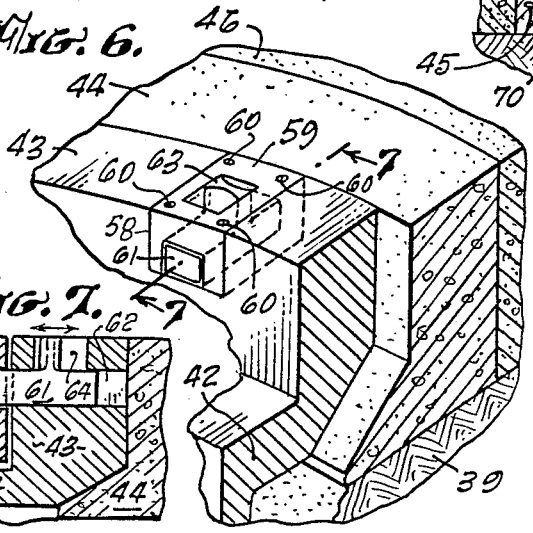
FIG. 6 is a fragmentary perspective view of a means for locking the table assembly in its down-mode.

A rim 42, FIGS. 3, 5, 6, is mounted on drum 34 at an open end thereof, being radially offset to drum 34 to obviate interference with table 21 in operation of the invention. An upstanding collar 43, FIGS. 5, 3 is integrally formed with rim 42 and provides a seat for drum 34 on a circumscribing precast concrete collar 44. Bonding cement, or means such as a plurality of spaced bolts 45, securely anchor drum 34 to concrete collar 44. Collar 44 in turn is mounted to and within the confines of a decking 46 or the like that is flush along its top with collars 43, 44, and with table 21 in the assembly's down mode position. A rigid retaining ring 47, preferably split for ease of installation, is mounted within collar 43 and about or on top of rim 42, secured suitably thereto such as by means of a series of spaced flush-head screws 48 around the rim, one of which being illustrated in FIG. 5. Ring 47 extends radially inwardly of drum 34 to form a barrier to prevent the table, or more particularly, annular segment 28 of extension member 25 of lower support member 23, from being lifted completely out of and free of drum 34 when it is being raised to its elevated mode, while providing a seat or barrier for the annular segment 28 on the extension member 25 of upper support member 22 when the table assembly is in its down mode. An inner edge 49, FIG. 5, of ring 47 co-acts with an upwardly extending endless projection 50 on lower extension member 25 to provide a seal to drum 34 when the table assembly is in its elevated mode or position.

Figure 4:
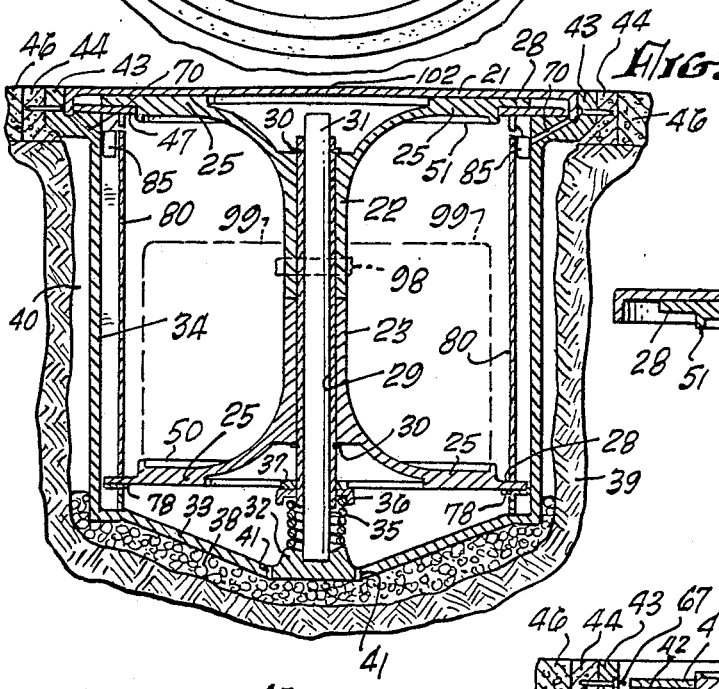
FIG. 4 is an elevational cross-sectional view of the invention in its down mode or position.

Corresponding configurations on the extension member 25 and annular segment 28 of upper support section 22, seen as cross-sections in reverse silhouttes in FIGS. 3, 4, are provided so that in the down mode for assembly 20, a flush ground appearance for table 21 occurs. The annular segment 28 of extension member 25 of upper support section 22 engages the topside of ring 47, FIG. 4, in the assembly's down mode. A downwardly extending or depending endless projection 51 on extension member 25 of upper support section 22 co-acts with inner edge 49 of ring 47, thereby firmly positioning table 21 at the floor level in the lower mode for assembly 20.

Figure 7:
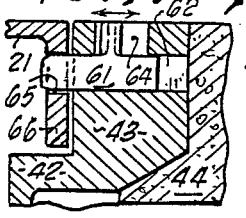
FIG. 7 is a view taken on line 7—7 of FIG. 6.

Turning to FIGS. 6 and 7, a means for locking table assembly 20 in its down mode, as well as preventing unintended rotation of the assembly, is illustrated. A recess 58 is provided at the top surface of collar 43 of drum 34, and in which a housing 59 is mounted securely by means of screws 60. A radially sliding locking member 61 is provided in a cage 62 of housing 59, having a finger latch 63 mounted on it and which extends upwardly through an opening 64 in cage 62, for actuating it radially. A hole 65, FIG. 7, is provided in a depending annular flange 66 mounted on table 21 to receive locking member 61 as it moves radially inwardly. Annular flange 66 seats in a gap 67, FIG. 5, in the down mode for the table assembly, provided between an outer peripheral edge 68 of ring 47 and the inner vertical wall 69 of collar 43 of drum 34. More than one of these locking means may be installed in an assembly 20.

It is to be noted that the seating of the lip of flange 66 in gap 67 when the assembly is in its down mode provides a seal for the unit when decking 46 or the like is hosed down or otherwise cleaned up. Also, another set of spaced drainage passages into drum 34, one of which being shown at 70 in FIG. 5, is included between the base (in rim 42) forming gap 67 and the interior wall 71 forming drum 34, so that run-off liquids, water or otherwise, can drain to gravel 38.

The table and its assembly 20 are guided as it moves between elevated and down modes. One or more guide means 72, FIGS. 8, 9, 10, preferably four equally distanced around drum 34, is provided. Each means 72 comprises a U-shaped channel member 73 securely mounted on the interior wall 71, FIG. 5, of drum 34 and is mated to or encompassed by a cut-out or slot 74, FIG. 5, provided in annular segment 28 of lower extension member 25 of support section 23. Channel member 73 extends generally the length of drum 34, while slot 74 guides annular segment 28 or support section 23 in its reciprocating motion as it displaces upwardly and downwardly as illustrated in FIGS. 8, 9, 10. A recess 75, FIGS. 8, 9, is fashioned in two of the three frame members forming channel member 73, by being shorter at their top than the top of the other side frame member 77 of channel member 73. A position bar 78 is secured on the underside of annular segment 28 adjacent slot 74 while a notch 79 is provided in a base frame member 80, FIGS. 8, 2, 4, of channel member 73 to receive position bar 78, to thereby releasably position table assembly 20 in its elevated mode, FIG. 10. Frame member 77 preferably extends upwardly to abut against retaining ring 47, however, in any event, it should be long enough at its top so that the striking of the one edge 81, FIG. 10, of slot 74 against it provides the signal to depress position bar 78 into its notch 79, in operation of the assembly.

In order to advance table assembly 20 into its releasable position in its down mode, each slot 74 in lower annular segment 28 descends over its corresponding channel member 73 until its extension member 25 on support section 23 clears the bottom of side frame member 76. Side frame member 76 is shorter at its bottom, FIGS. 8–10, than at the bottom of its opposing side frame member 77, to thereby fashion a recess 82 in channel member 73. Consequently, annular segment 28 can be rotated or shifted in a direction opposing that of arrow 83 in FIG. 8, until edge 81 of slot 74 enters recess 82 and abuts the longer side frame member 77 and as illustrated in FIG. 8. The assembly is now releasably positioned in its down mode.

It should be clear now that the locking means illustrated in FIGS. 6, 7 also prevents unintended rotation of the table assembly between the limits of the width of slot 74 in annular segment 28, while compressed coiled spring 35 assists in the frictional engagement of annular segment 28 in recess 82 with the bottom of side frame member 76 to maintain the downmode releasable position for the table assembly.

It is to be noted that four guide means and counterweight balancing mechanisms (described in following paragraphs) are preferably included in the apparatus 20, however, as many or as few of each as desired may be included.

Means 84 is provided, FIGS. 8, 9, 10, 5, to balance the reciprocating movement of table assembly 20 as it moves between its lower and elevated modes. Means 84 comprises a weight 85 hanging from a suitable length of rope or cable 86, and mounted within the channel formed by the elongated U-shaped formation of channel member 73. The length of cable 86 extends upwardly from its weight 85 to pass through an aperture 87, FIG. 5, formed in base frame member 80 of guide means 72, thereafter extending to its secured connection on the underside (not visible in FIG. 5) of annular segment 28 of lower extension member 25 in support section 23. Though such connection is not visible in FIG. 5, any suitable known method of attachment between rope or cable to section 23 can be used.

Figure 13:
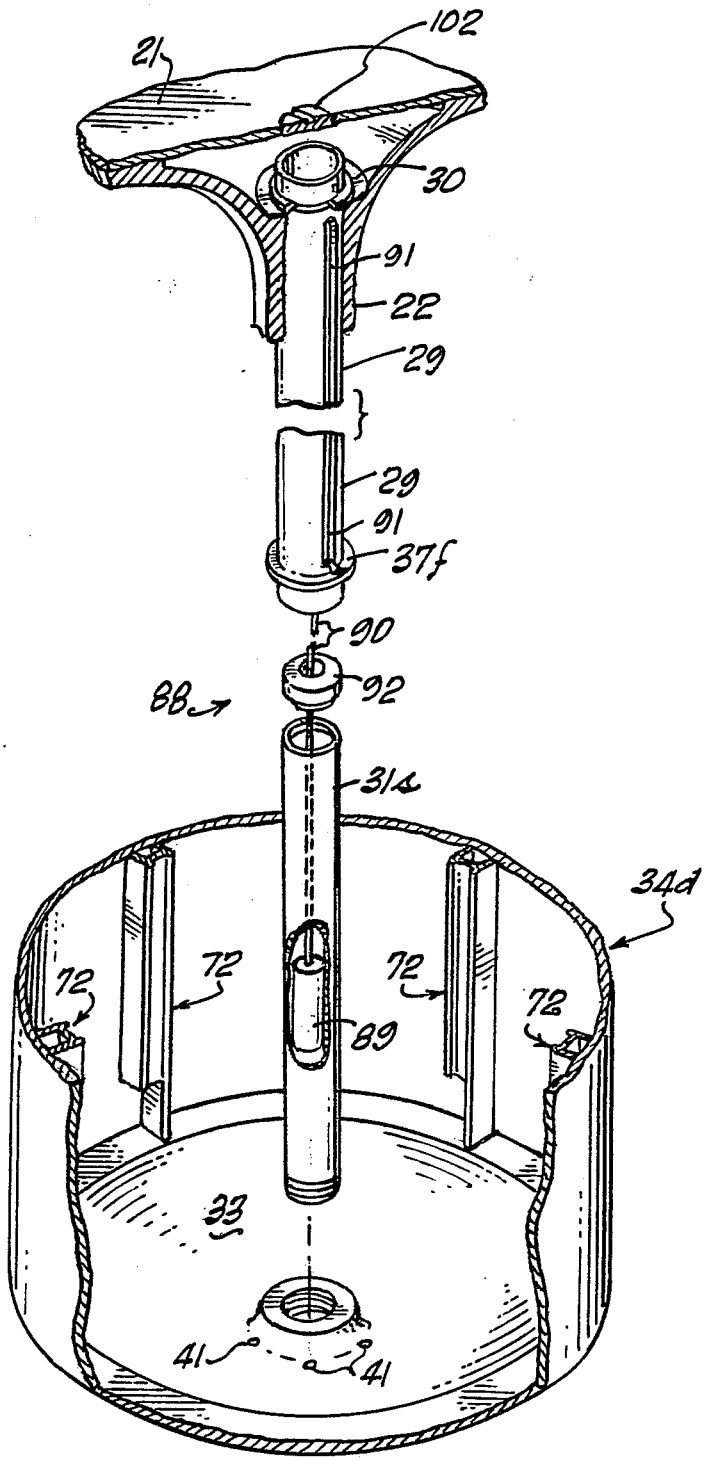
FIG. 13 is an exploded perspective view, partially broken away, showing an embodiment employing a different counter-weight balancing mechanism for the table assembly.
Figure 14:
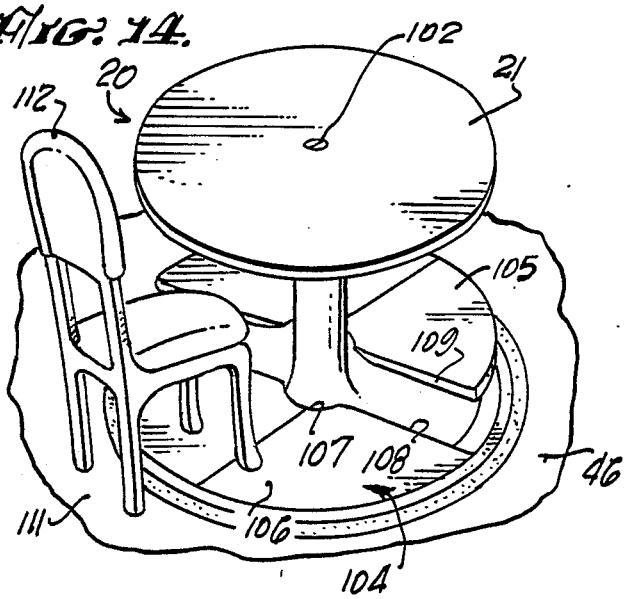
FIGS. 14 and 15 are perspective views of floor panels utilized in the invention.

Another balancing mechanism 88 is illustrated in FIG. 13. This balancing system is centrally oriented of a drum 34*d*, as contrasted to the previously described mechanism. Mechanism 88 comprises a suspended weight 89 securely mounted to one end of a chain or cable 90, while its other end is suitably secured to an annular flange 37f mounted about tube 29, the chain 90 being threaded through an elongated slot 91 in tube 29. Displacement of weight 89 is restricted vertically by reason of its containment within a fixed hollow guide sleeve 31s for tube 29. An apertured cap 92 threaded atop sleeve 31*s* maintains moving clearance to chain 90 as tube 29 reciprocates upon sleeve 31*s*. As tube 29 is caused to reciprocate downwardly, carrying table assembly 20 with it, weight 89 raises within sleeve 31s, chain 90 riding over cap 92 and through slot 92 as flange 37*f* moves down. Conversely, as tube 29 is caused to elevate on sleeve 31*s*, more of chain 90 enters through slot 91, though cap 92, and into sleeve 31*s*, weight 89 descending.

FIGS. 11, 12, and 1 illustrate a plurality of clips 98 securely mounted about upper support section 22 and to each of which a stool 99 or other seating furniture is mounted between the spaced extension members 25 and secured during storage. The seating furniture 99 includes an aperture 100 adjacent its base, in its inner leg 101 which, when the furniture is up-ended, is inserted upon one of the clip members 98 for hooking itself thereto. Stool 99 is fully enclosed within storage space 27 in the down mode for assembly 20.

FIGS. 1 and 3 illustrate further the feature of a plug 102 centrally disposed in and through table 21. Plug 102 is removed for insertion within tube 29, FIG. 3, of a pole 103 of an umbrella (not shown) for shading occupants seated on furniture 99 about elevated table assembly 20. The bottom of pole 103 seats upon the top of the stabilizing shaft 31.

FIGS. 14–17 illustrate features of a floor panel 104 with and for table assembly 20. Floor panel 104 comprises a pair of stiff or rigid semi-circular members 105, 106 formed from suitable material, having a central aperture 107 formed in the cooperation of their abutting diametrical edges 108, 109, respectively, as panel 104 is set in position above ring 47 of drum 34. The bottom of each floor panel member 105, 106 is reinforced by structural ribs 110, FIGS., 15, 17. Each member 105, 106 is configured to fill the space generated by the floor plane 111, FIGS. 3, 14, 16, and by and the configuration of wall 69 of collar 43, gap 67, retaining ring 47, and extension member 25 of upper support section 22, as well as being supported by the configurations of these elements. Thus, the weight of a chair 112, FIG. 14, and its occupant can be readily supported with floor panel 104 in place. Also, obstacles or interfering projections in the constructed configuration of table assembly 20 that could cause non-levelness for an occupant's or chair's feet are eliminated.

Figure 15:
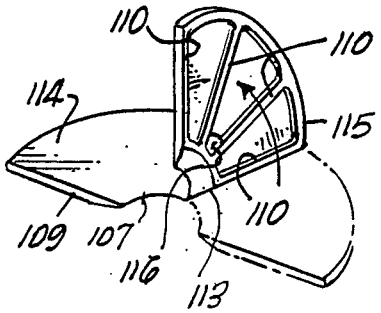
Figure 16:
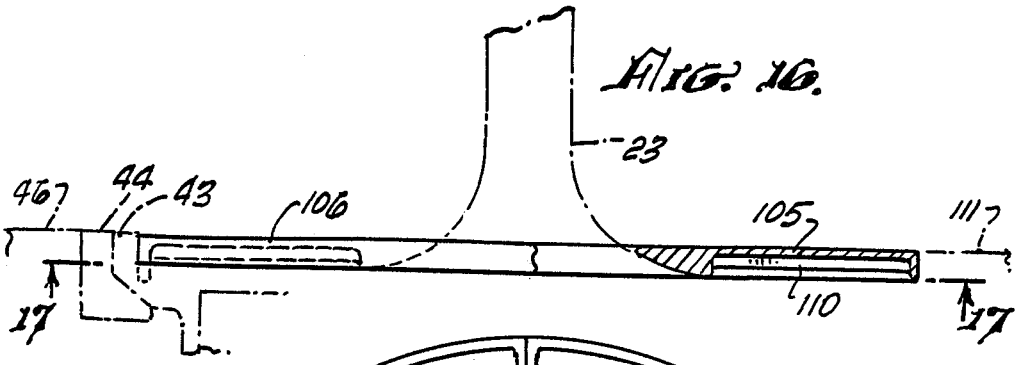
FIG. 16 is a fragmentary sectional view in cross-section of a floor panel mounted in place in operation of the invention.
Figure 17:
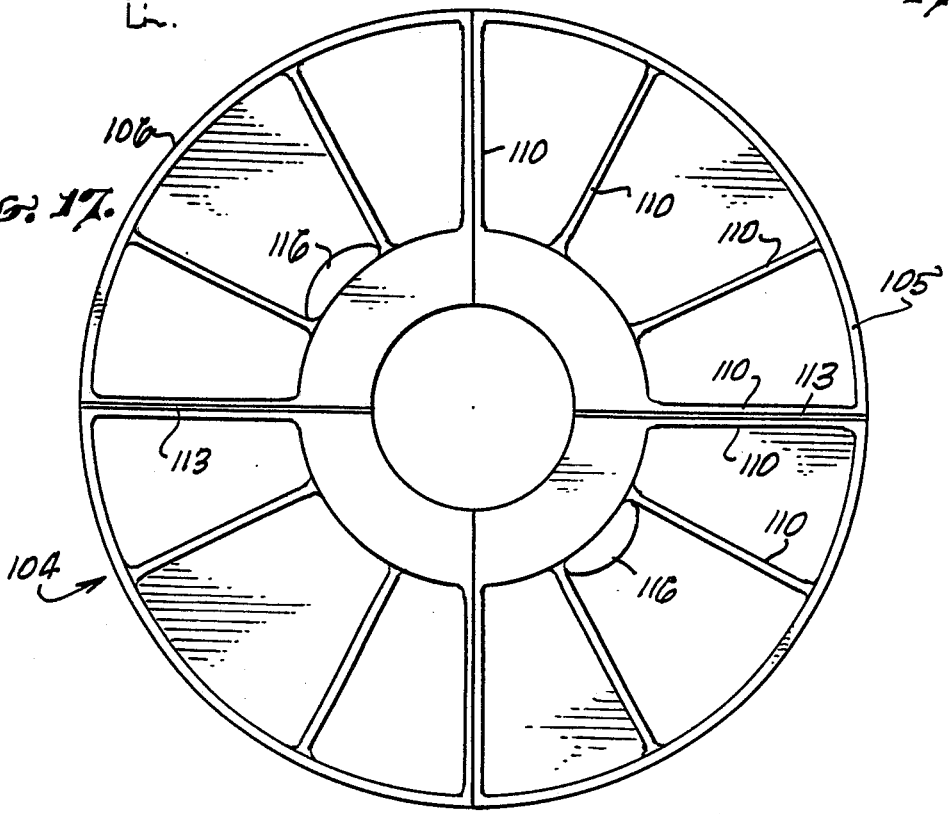
FIG. 17 is a view taken on line 17—17 of FIG. 16.

FIGS. 15, 17 illustrate further a folding-up feature for each member 105, 106 of floor panel 104, whereby each can be secured in table assembly 20's down mode. Suitable folding means, such as hinges 113 or "living hinges" composed or contained in a bendable top of panel 104, are mounted and secured to sub-sections 114, 115 of each member 105, 106, in order for such sub-sections to fold upon each other for storage purposes, while a hanging loop 116 is suitably secured to the underside of one of the sub-sections 114, 115 adjacent its portion forming central aperture 107. Each hanging loop 116 is hung on a clip 98 mounted on table support section 22 in the same manner as is furniture 99, FIG. 1.

In operation, with table 21 in its releasable position in its down mode, finger latch 63, FIG. 6, is flipped radially outwardly of drum 34, from its position shown in FIG. 7 to that shown in FIG. 6. Locking member 61 no longer engages hole 65 in table flange 66. The top of table 21 then is manually rotated, FIG. 8, in the direction shown by arrow 83, so that edge 81 of slot 74 in annular segment 28 on extension member 25 of lower support section 23 abuts the outside of side frame member 76 of U-shaped channel member 72, FIG. 9. Circular flanged plate 36, FIGS. 3, 4, reacts against annular flange 37 to raise tube 29, or table top 21 somewhat above plane 111, by the compressive force of coiled spring 35. Table 21 is no longer flush with floor plane 111 and is grasped for elevating assembly 20 upwardly, FIG. 9, in the direction of arrow 117, coming out of its location in drum 34, to be raised to its position shown in FIGS. 1 and 3. Upon 28 reaching its height as shown in FIG. 10, the assembly is rotated in the direction of the FIG. 10 arrow 118 in order for edge 81 of slot 74 to abut the longer side frame member 77, which in turn signals the operator to push table 21 down into a releasable position in its elevated mode, as locking bar 78 can enter notch 79 thereby, to lock and balance assembly 20 in its elevated mode.

As table assembly 20 is elevated, weight 85 in the chamber generated within rail members 77, 80 and 76, FIGS. 8, 9, 10, moves downwardly, balancing such assembly while elevating it, thus, countering the effect of the weight of the assembly. In the FIG. 13 embodiment, as table assembly 20 and its tube 94 elevate, weight 89 moves downwardly to likewise balance the assembly as it elevates.

Furniture seats 99 are removed from their supporting clip members 98, uprighted as in FIG. 12, and made ready for seating someone about table assembly 20. Or other furniture seats may be drawn up to table 21, such as illustrated by chair 112. If desirable, plug 102 is removed for insertion of an umbrella pole 103 into tube 29, the bottom of which being suitably supported by the rim of the support tube 29.

Floor panel members 105, 106, if folded, and hung by loops 116 on clips 98, are removed from loops 116 and unfolded as in FIG. 15, and disposed upon the top of drum 34, for interfacing thereacross, with central aperture 107 engaging lower table support section 23 or its extension member 25 or annular segment, so as to provide a flush appearance under table 21 with floor plane 111.

To return table assembly 20 to a down mode, furniture 99 and/or floor panel members 105, 106, FIG. 15, are upended and/or folded, as the case may be, their respective hooking means 100 or 116 hooking onto clips 98. It should be understood that should storage of such furniture not be desired, they need not be so hooked. Table 21 is grasped and raised slightly, to release position bar 78 from its notch 79 so that the table can be rotated in a direction against that shown by directional arrow 118 of FIG. 10. Slot 74 in annular segment 28 of extension member 25 of lower support section 23 now encompasses U-shaped channel formation 72. Table 21 is pushed downwardly, tube 29 telescoping upon stabilizing shaft 31. Plate 36 is caused to compress coiled spring 35 as annular flange 37 strikes plate 36. As soon as annular segment 28 clears the bottom of side frame member 76, table 21 is in its down mode. It then is rotated in a direction against the directional arrow 83, FIG. 8. The one edge 81 of slot 74 engages the longer side frame member 77 of guide means 72. The unit 20 now is in its releasable position. Finger latch 63 now becomes operable. It slides locking member 61 into hole 65 in annular flange 66 of table 21 to lock it in its down mode.

The assembly of the subject matter of the invention can be accomplished in absence of soil 39 and gravel 38, however, preferably, cavity 40 is first formed in ground soil 39 or in structure below floor plane 111 in which the apparatus is to be installed. Gravel 38 is added to ground soil 39 prior to insertion of drum 34 in cavity 40 in the event installation is made in the ground. Collar 43 abuts against prefabricated concrete collar 44 which has been previously installed in floor, decking or other foot-carrying structure 46, while screws 45 assist in securing drum 34 in place in its cavity and to its flooring. Stabilizing shaft 31, along with spring 35 and spring cap 36, are securely mounted in place upon hub 32. Thereafter the assembled table 21, table support sections 22, 23, and metal tube 29 are mounted upon shaft 31. Ring 47 then is secured in place by screws 48 upon rim 42 of drum 34, or may be bonded thereto if desired.

Previously, support sections 23, 24 are mounted to support tube 29, after which retaining rings 30 are applied to tube 29 to hold them in position. Table 21 and clip members 98 are suitably secured to support section 23 at any step during assembly.

Prior to and during installation of support sections 23, 24 upon stabilizing shaft 31, guide means 72 and balancing means 84 are installed. Each metal U-shaped channel formation 72 is suitably secured such as by welding to inner wall 71 of drum 34. Prior to or after such securement, as the case may be, weight 85 and its rope or cable 86 are mounted in the channel of formation 72 with the cable's length thrust through aperture 87 in the base frame member of formation 72. The other end of cable 86 is attached to the underside of section 23 prior to dropping it upon shaft 31. In so dropping, each slot 74 in the annular segment 28 of extension member 25 of body formation 23 encompasses its corresponding channel member 72 in its fixed location on interior wall 71 of drum 34.

With suspended weight 89, one end of cable 90 is attached thereto after which it is dropped into hollowness provided in sleeve 31s. Its other end is threaded through apertured cap 92 which is then secured to sleeve 31s, and with the insertion of sections 22, 23 into sleeve 31s, such other end is passed through to project past elongated slot 91, to be attached to annular segment 28.

Housing 59 with assembly of the sliding locking member 61 and finger latch 63 may be installed, FIG. 6, at a suitable juncture in the steps of assembly. Each position bar 78 already has been mounted on the underside of annular segment 28, while channel member 73 has been pre-fabricated. The folding floor panel means 104, together with furniture 99 are pre-fabricated to assembly 20 in such a manner as to conform to the latter's design for inclusion therewith.

Suitable materials are utilized to fabricate in known manner the various components described above. The table may be fabricated from high impact plastic with a non-skid surface for safety when the table assembly is in its down mode. The table also may be integral with the upper of the extension members. Steel tubing and stock bar or tube are utilized for elements 29, 31. Likewise, metal or other suitable material, such as plastic, forms channel member 72. The storage drum is constructed from fiberglass or reinforced plastic, as well as from other suitable metal. Collar 43 is preferably of material capable of being bonded to precaste concrete collar 44. Ring 47 is formed from rigid plastic.

INDUSTRIAL APPLICABILITY

This invention is readily useful in patio areas at homes, hotels, in dining rooms in hotels or other large facilities, convention halls, motels, etc., wherever large or small number of people are gathered together.

I claim:

1. A table assembly reciprocable between elevated and down mode positions and comprising a hollow drum including an endless wall with a bottom end and an open end therebetween and with a rim about the open end, an upright shaft centrally fixed to said bottom end extending towards such open end, a support means telescopically mounted on said shaft whereby said table assembly achieves its elevated and down mode positions, spaced upper and lower means securely mounted on said support means, said upper means adapted for mounting a table thereto, said lower means extending to said endless wall and including one or more annular segments, a chamber being generated in said drum between said spaced means in the down mode position, means for guiding said one or more annular segments between the elevated and down mode positions mounted on said endless wall, and means for releasably positioning said assembly in its elevated mode, said positioning means comprising (a) bar means mounted on said one or more annular segments, (b) notch and first recess means formed in at least one of said guiding means, said one or more annular segments being rotatable so that said bar means enters and withdraws from the first recess means and to be depressed into and raised out of said notch means, thereby releasably positioning in a stationary manner said assembly in its elevated mode.

2. The table assembly of claim 1 including
means for releasably positioning said assembly in its down mode position.

3. The table assembly of claim 2 wherein
said means for releasably positioning said assembly in its down mode position comprises
second recess means adjacent the bottom end of said drum and formed in at least one of said guide means,
said one or more annular segments being rotatable in the down mode position to cause it to enter and to withdraw from said second recess means.

4. The table assembly of claim 1 or claim 2 or claim 3 including
means mounted on said rim for limiting upward movement of said one or more annular segments.

5. The table assembly of claim 4 wherein
said limiting means comprises a barrier extending inwardly of said drum for cooperative action with said one or more annular segments.

6. The table assembly of claim 1 or claim 2 or claim 3 including
means for counter-balancing said assembly in such reciprocal motion operatively connected to said spaced lower means.

7. The table assembly of claim 6 wherein
at least one of said guiding means comprises a U-shaped channel member,
said one or more annular segments including a cut-out in which such one of said guiding means is disposed,
said counter-balancing means comprising
a weight and a cable attached to said weight, both weight and cable slidably mounted in said U-shaped channel member, said cable projecting through said channel member adjacent said rim and being attached to said one or more annular segments.

8. The table assembly of claim 4 including
means for counter-balancing said assembly in such reciprocal motion operatively connected to said spaced lower means.

9. The table assembly of claim 8 wherein
said one or more annular segments includes a cut-out in which each said guiding means is disposed,
said counter-balancing means comprising
a weight and a cable attached to said weight, both weight and cable slidably mounted in one or more of said guiding means, said cable projecting through said one or more of said guiding means adjacent said rim and being attached to said one or more annular segments.

10. The table assembly of claim 1 or 2 including means for locking said assembly in its down mode position mounted to said rim for operable connection with a table adapted to be mounted to said upper means.

11. The table assembly of claim 10 wherein
said locking means comprises
a cage having a first and a second opening,
a member mounted in said cage slidable through said first opening by manipulating it through said second opening,
said member adapted to engage and disengage a hole formed in a flange a of table upon sliding through said first opening.

12. The table assembly of claim 1 or claim 2 or claim 3 including
means for securing furniture or the like mounted on said support means.

13. The table assembly of claim 4 including furniture or the like,
said furniture or the like comprising
one or bmore floor panel means including a central aperture disposed about said support means and
a configuration on said one or more floor panel means mounted on said limiting means and on said one or more annular segments.

14. The table assembly of claim 13 wherein said one or more floor panel means is foldable.

15. The table assembly of claim 13 including
means for securing said furniture or the like mounted on said support means.

16. The table assembly of claim 8 wherein
said counter-balancing means comprises
a weight and a cable attached to said weight,
said shaft being hollow,
said support means including a tube having a longitudinal slot and being reciprocably mounted on said shaft,
said weight and cable disposed in said hollow shaft, with the cable projecting through such longitudinal slot and being attached to said tube.

17. The table assembly of claim 6 including counter-balancing means comprising
a weight and a cable attached to said weight,
said shaft being hollow,
said support means including a tube having a longitudinal slot and being reciprocably mounted on said shaft,
said weight and cable disposed in said hollow shaft, with the cable projecting through such longitudinal slot and being attached to said tube.

18. The table assembly of claim 17 including means for securing furniture or the like mounted on said support means.

19. The table assembly of claim 18 including furniture or the like, said furniture or the like comprising
one or more floor panels means including a central aperture disposed about said support means and
a configuration on said one or more floor panels means mounted on said limiting means and on said one or more annular segments.

20. The assembly of claim 19 wherein said one or more floor panel means is foldable.

21. The table assembly of claim 1 or claim 2 or claim 3 including drainage means mounted in the bottom end of said drum.

22. The table assembly of claim 21 including
a second drainage means mounted in said rim with its being exposed at the open end and at the endless wall of said hollow drum.

* * * * *